United States Patent [19]

Brezette et al.

[11] Patent Number: 5,014,384

[45] Date of Patent: May 14, 1991

[54] PAD ATTACHMENT FOR PAINT ROLLER ASSEMBLIES

[75] Inventors: Michael W. Brezette, Naperville, Ill.; Robert A. Shaffer, Kenosha, Wis.; Fredrick B. Burns, South Milwaukee, Wis.; Howard R. Moon, Fort Atkinson, Wis.

[73] Assignee: EZ Paintr Corporation, Milwaukee, Wis.

[21] Appl. No.: 351,750

[22] Filed: May 15, 1989

Related U.S. Application Data

[63] Continuation-in-part of Ser. No. 46,327, May 6, 1987, Pat. No. 4,829,628.

[51] Int. Cl.[5] ..... B05C 17/02

[52] U.S. Cl. ..... 15/230.11; 15/118; 15/246; 15/248 A

[58] Field of Search ..... 15/230.11, 246, 118, 15/248 A, 210 R, 114; 29/110.5, 120

[56] References Cited

U.S. PATENT DOCUMENTS

| | | | |
|---|---|---|---|
| 3,346,899 | 10/1967 | Murphy | 15/230.11 |
| 3,359,589 | 12/1967 | Moore | 15/210 R |
| 3,611,469 | 10/1971 | Belli | 15/210 R |
| 3,942,209 | 3/1976 | Walls | 15/230.11 |
| 4,219,899 | 9/1980 | Zurawin et al. | 15/210 R |
| 4,528,712 | 7/1985 | Leibow | 15/230.11 |

FOREIGN PATENT DOCUMENTS

| | | | |
|---|---|---|---|
| 1377971 | 12/1974 | United Kingdom | 15/230.11 |

*Primary Examiner*—Edward L. Roberts
*Attorney, Agent, or Firm*—Baker & McKenzie

[57] ABSTRACT

A pad attachment for a paint roller assembly including a pad holder affixed to a roller type paint applicator. The pad holder retains a paint trimming and smoothing material in a form of a fabric or foam. The material retained by the holder is positioned to smooth or otherwise treat the paint being applied by the roller during a painting application. In addition, the material may function to trim or "cut in" at the interface of a surface adjacent the surface being painted. In an alternative embodiment, the invention may be part of a paint roller assembly having an adjustable splatter shield. The pad holder is integrally formed with the shield and is removably retractable and extensible along with the shield.

6 Claims, 3 Drawing Sheets

PAD ATTACHMENT FOR PAINT ROLLER ASSEMBLIES

BACKGROUND AND SUMMARY OF THE INVENTION

This is a continuation-in-part of U.S. application Ser. No. 46,327, filed May 6, 1987, now U.S. Pat. No. 4,829,628.

FIELD OF THE INVENTION

The present invention generally relates to painting implements and, more particularly, is concerned with an attachment pad for use with paint roller assemblies for smoothing or otherwise treating the paint film being applied by the roller and for trimming or "cutting in" along surfaces adjacent to the surface being painted.

DESCRIPTION OF THE PRIOR ART

Rollers of many designs are commonly used applicators of paint and the like to surfaces. Although paint rollers are capable of superior results, the quality of application and texture of the applied paint is largely dictated by factors, such as the type of roller, the properties of the paint, and the physical characteristics of the surface being painted. Known paint brush constructions have been deficient in providing an accessory or cooperating element that is capable of being affixed to the paint roller assembly for improving the quality or modifying the appearance of the film being applied.

The inherent configuration of a paint roller also causes difficulty in painting or trimming corners at the intersection of a surface adjacent the surface being painted, such as along a ceiling, door frame, and the like. As a result, it is often necessary to trim corners of intersecting surfaces by using brushes or other separate devices.

Consequently, a need exists for improvements in painting of surfaces with rollers by which the applied paint can be further enhanced through smoothing or other treatment during the painting operation. A need further exists for improvements in the trimming of intersecting surfaces while using a paint roller assembly.

SUMMARY OF THE INVENTION

It is an objective of the present invention to provide a unitary pad attachment for a paint roller assembly to provide a paint trimming and surface treatment capability to the paint film being applied. The attachment pad device of the invention is directly affixed to the roller assembly, or to a moveable shield carried by a roller assembly, so that a material, such as a fabric or foam face, contacts the applied paint film for smoothing or creating some other aesthetic effect. In addition, the attachable pad device herein disclosed is capable of a trimming or "cutting in" operation at the corners of intersecting surfaces during use of the roller. The foregoing enhancement of the paint surface and trimming capability of the invention are attained by an inexpensive device that is lightweight and does not interfere with the expected ease of loading paint with a roller.

DETAILED DESCRIPTION OF THE INVENTION

Figure 1:
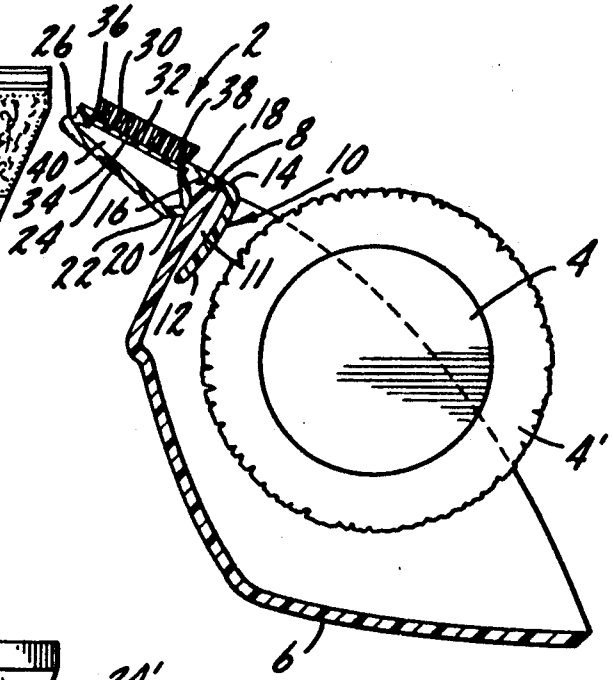
FIG. 1 is a side elevational view, with parts in section, of a first embodiment of the pad attachment device for paint roller assemblies of the present invention.

Referring now to FIG. 1, there is illustrated a first embodiment of the pad attachment device of the present invention shown affixed to an existing paint roller assembly and generally designated by reference numeral 2. The known paint roller assembly includes a paint roller 4 having a circumferentially arranged fabric or fiber material $4^1$ that absorbs paint and applies a film to the surface being painted. In the assembly shown in FIG. 1, the roller 4 is rotatably mounted by means (not shown) to a paint shield housing 6 also of a known configuration. The housing 6 may include a handle for manipulation of the roller assembly in use and end walls (not shown). Although the invention is shown in conjunction with a paint shield housing, the invention may also be attached to other paint roller assemblies by suitable techniques (not shown).

Figure 3:
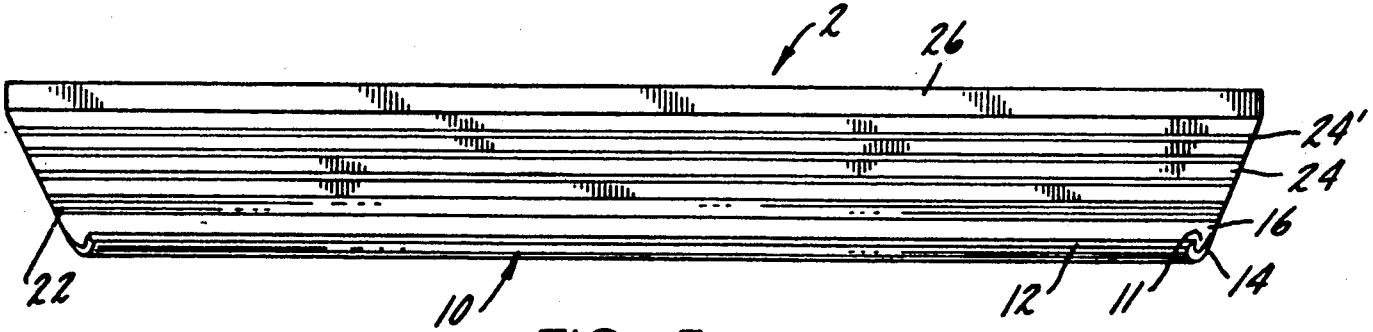
FIG. 3 is a top plan view of the pad attachment device shown in FIG. 2 having a modified trapezoid configuration.

The pad attachment device 2 is mounted on an enlarged lip 8 of housing 6 and extends in substantially parallel relationship to the axis of rotation of the roller 4. The pad attachment device 2 includes a single piece, pad holder 10, which may be molded or otherwise formed from a plastic material. Pad holder 10 is arranged to snap into fixed position substantially over the length of the enlarged lip 8 of the paint shield housing 6. As seen in FIGS. 1 and 3, the pad holder 10 includes a retention pocket 11 formed by a somewhat curved inner housing wall 12, an integral end surface 14, and an outer section 16 disposed on the surface of lip 8 as seen in FIG. 1. The wall 12 and outer section 16 cooperate to form opposing elongated legs of a resilient elongated clip, which allows the pad holder 10 to be snapped onto the edge of the paint shield housing 6. The opposing legs engage the housing in such a way as to prevent rotation of the pad holder about the edge of the housing. The outer portion 16 is formed with a recess 18 having an approximate shape corresponding to the outer enlarged face of lip 8. The enlarged lip 8 may be positioned into the pocket 11 of pad holder 10 with recess 18 snapping into retention on the lip 8.

As further seen in FIG. 1, a portion 20 of the pad holder 10 angularly diverges outward from the outer surface of the housing 6 and terminates with a protuberance 22. A wall 24 projects outward from protuberance 22 and housing 6, and terminates with an outer edge portion 26 that retains the outer edge of a pad 30. The wall 24 may have a series of strengthening slots 24 as best shown in FIG. 3. As seen in FIG. 1, the pad includes a painting face 32 formed from a suitable material, such as fabric, foam, and the like, that is adhesively bonded to a rigid or semi-rigid backing member 34 by any known technique. The pad 30 is affixed to the holder 10 by retention in a pair of opposed open-ended slots 36,38 respectively formed on outer edge portion 26 and outer section 16 as seen in FIG. 1. The pad 30 may be replaced or mounted in position by being slid lengthwise in the open ended slots 36,38 or preferably, in the embodiment of FIG. 1, the holder is hollow in enclosed area 40.

The holder 10 and pad 30 are arranged to span approximately the length of the housing shield 6 adjacent the roller 4 to provide contact with the surface being painted. As should be apparent in the foregoing description, the painting face 32 trails the roller 4 as it applies paint to a surface and acts to smooth the film applied by the roller. The surface of face 32 is disposed in a plane that is approximately tangential to the interface between the roller 4 and the surface being painted. Although the fabric painting face 32 shown in FIGS. 1 and 2 acts to smooth a paint film, the configuration and texture of the face 32 can be modified to create other painting effects when desirable. While the pad attachment device 2 is further shown as an attachable fixture to the paint roller housing 6 in FIG. 1, it is within the scope of the invention to mold or otherwise fabricate the housing 6 and pad attachment device 2 as a unitary body (not shown) with the pad 30 being insertable or removable in slots 36,38.

Figure 2:
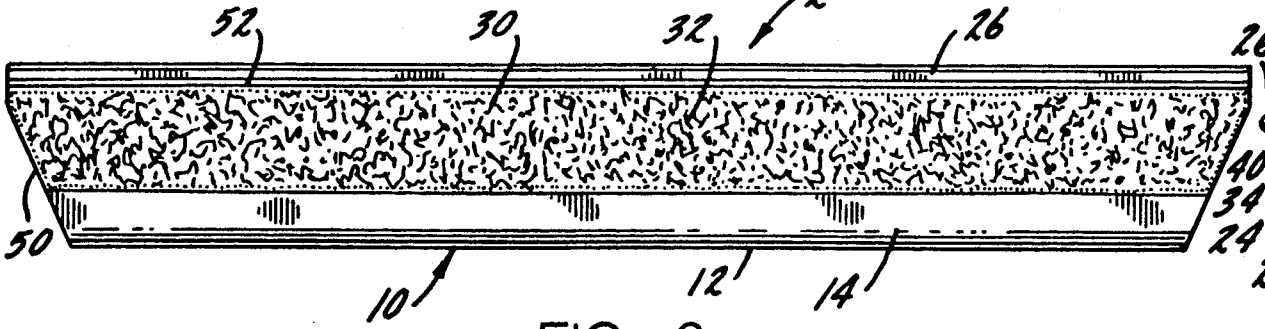
FIG. 2 is a bottom plan view of the paint face of the pad attachment device shown in FIG. 1 having a trapezoid configuration.

In FIG. 2, the paint face 32 is shown having a trapezoid shape 50, with the largest side 52 being the farthest from the axis of rotation of the roller 4. The face 32 forms an extended outward dimension in vicinity of side 52.

Figure 4:
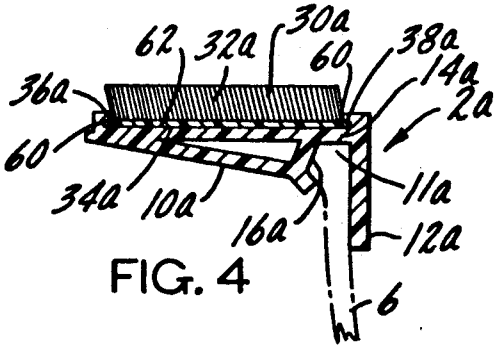
FIG. 4 is a partial side elevational view, with parts in section, of another embodiment of the pad attachment device of the embodiment showing first technique for attaching a paint pad and a modified base.

Referring now to FIG. 4, there is another embodiment of the pad attachment of the invention generally designated as reference numeral **2*a*. The pad holder 10*a* is modified from the holder shown in preceding FIG. 1, and includes a solid molded configuration. The pocket 11*a* formed by portions 12*a*, 14*a*, and 16*a* snaps on the shield housing 6 in a similar manner as previously described. The pad 30*a* includes a fabric painting face 32*a* and a semi-rigid backing member 34*a* of any selected material. The backing member 34*a* includes opposed extended portions 60 that slide into the slots 36*a* and 38*a* formed in the bottom of body 10*a*. The slots 36*a* and 38*a* confront each other adjacent to a cutout area 62 of the holder 10 which receives the pad 30*a***.

Figure 5:
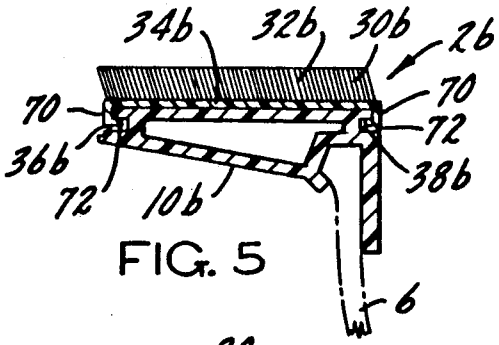
FIG. 5 is a partial side elevational view, with parts in section, of still another embodiment of the pad attachment device of the present invention showing an alternative technique for attaching the paint pad.

Referring now to FIG. 5, there is illustrated still another embodiment of the pad attachment **2*b* of the invention. The pad holder 10*b* of pad attachment 2*b* has a slightly modified design than the holder 20*a* shown in FIG. 4. Specifically, the bottom face of the pad holder 10*b* is flat, while the slots 36*b* and 38*b* are formed on the lower outer sides of the pad holder 10*b*. The edge portions 70 of the semi-rigid backing material 34*b* are bent back in a modified U-shaped configuration so that the inner directed edges 72 engage the slot 36*b*, 38*b*. The pad 30*b* with face 32*b*** may be slid into position lengthwise as in the previous embodiments.

Figure 6:
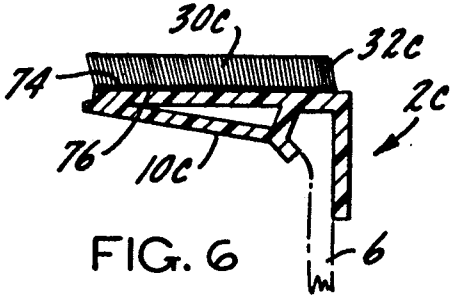
FIG. 6 is a partial side elevational view, with parts in section, of still another embodiment of the pad attachment device of the present invention showing a third technique of attachment of the fabric painting pad.

Referring now to FIG. 6, there is illustrated another embodiment of the pad attachment device of the present invention, generally designated by reference numeral **2*c*. The pad holder 10*c* of pad attachment device 2*c* is similar to the pad holders of the preceding embodiments, except that the slots for retention of the painting faces have been eliminated. In addition, paint face fabric 32*c* is directly affixed to the bottom 74 of the holder 10*c* by use of a suitable adhesive 76**.

Figure 7:
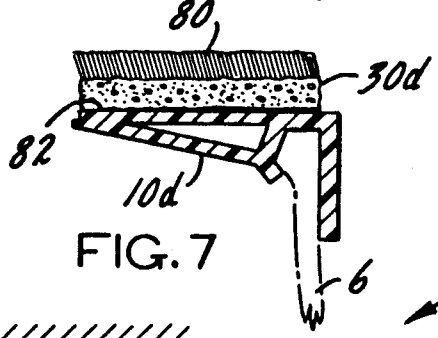
FIG. 7 is a partial side elevational view, with parts in section, of another embodiment of the pad attachment device of the present invention having a flocked foam painting face.

Referring now to FIG. 7, there is illustrated another technique for attaching the paint face to the holder. The holder **10*d* is the same general configuration as the holder 10*c* of the embodiment of FIG. 6, but the painting face 30*d* comprises a flocked foam painting face 80 that is affixed to the face of the holder by an adhesive bond 82**.

In the foregoing description of the embodiments of FIGS. 4 through 7, four alternative ways for attachments and forms of painting face have been described. Each of these techniques can be utilized in conjunction with the holder device of FIG. 1, if desired.

Figure 8:
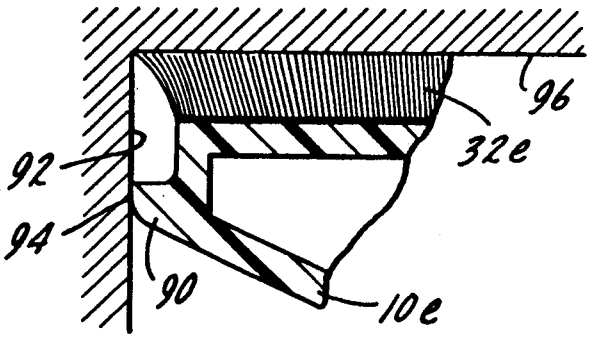
FIG. 8 is a partial side elevational view, with parts in section, of still another embodiment of the pad attachment device having an extended portion for trimming.

Referring to FIG. 8, the holder **10*e* of the invention is shown formed within extended portion 90 along its outer face in parallel relationship to the axis of rotation of the roller (not shown). The extended portion 90 is intended to contact an adjacent wall 92 at edge 94 to space the remaining portions of holder 10*e* from the wall. In this position, the painting fabric face 32*e* projects outward when pressed against surface 96 to approach the intersection of the surfaces 92 and the painting surface 96 so that the face with retained paint can trim or cut in along a ceiling, door frame or other surface adjacent to the frame being painted. This offers an improved ability of a paint roller device to trim corners which is difficult with present designs. The extended portion 90 is offset from the face 32*c* to prevent paint from migrating to the edge 94** for unsatisfactory trimming results.

Figure 9:
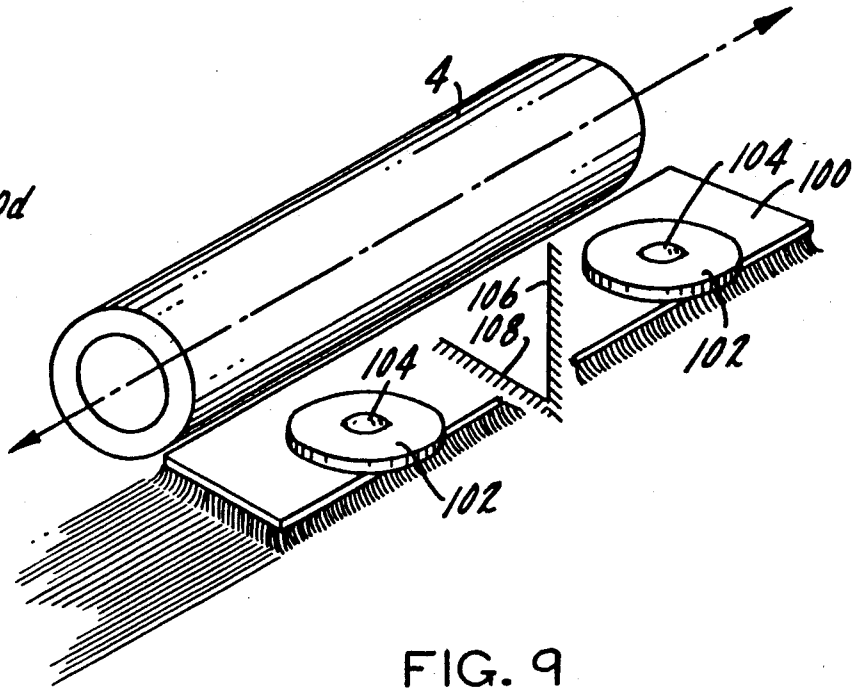
FIG. 9 is a side perspective illustration of still another embodiment of the pad attachment device of the present invention having wheels.

Referring now to FIG. 9, a modification of the trimming capability of the pad attachment device of the present invention is shown. Although the holder of the facing can encompass any of the foregoing shapes, for purpose of illustration, the pad holder 100 is shown with a flat configuration. A pair of wheels 102 are mounted in shafts 104 for rotation about axis extending perpendicular to the axis of rotation of roller 4. The wheels 102 permit the attachment device to be moved along wall 106 in parallel relation to the axis of rotation of the roller 4, such as during lifting the roller or otherwise traversing the surface 108 being painted for improved trimming results.

Figure 10:
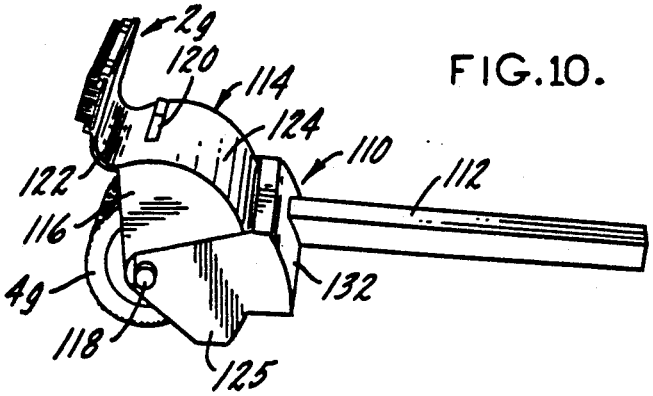
FIG. 10 is a perspective view of another embodiment of the present invention showing a paint roller and paint application assembly which employs an adjustable shield.

FIGS. 10 through 15 show a fifth alternative embodiment of a pad attachment of the present invention. FIG. 10 shows a perspective view of the fifth embodiment, in which a paint roller assembly 110 includes a handle 112 extending from a yoke-like crossmember 132. The crossmember 132, together with the side supports 125 and the moveable shield 114, comprise a housing 6g for the roller 4g. The movable shield 114 comprises a bridging section 124 and flexible end walls 116. The flexible end walls 116 and the side supports 125 have apertures which engage a post 118 at each end of the roller 4g. The movable shield 114 has a connecting section 122 along one edge thereof, which connects the pad holder 2g to the moveable shield 114. A knob 120 is disposed on the bridging section 124 of the moveable shield, and operates as a stop to limit rotational movement of the moveable shield in one direction.

Figure 11:
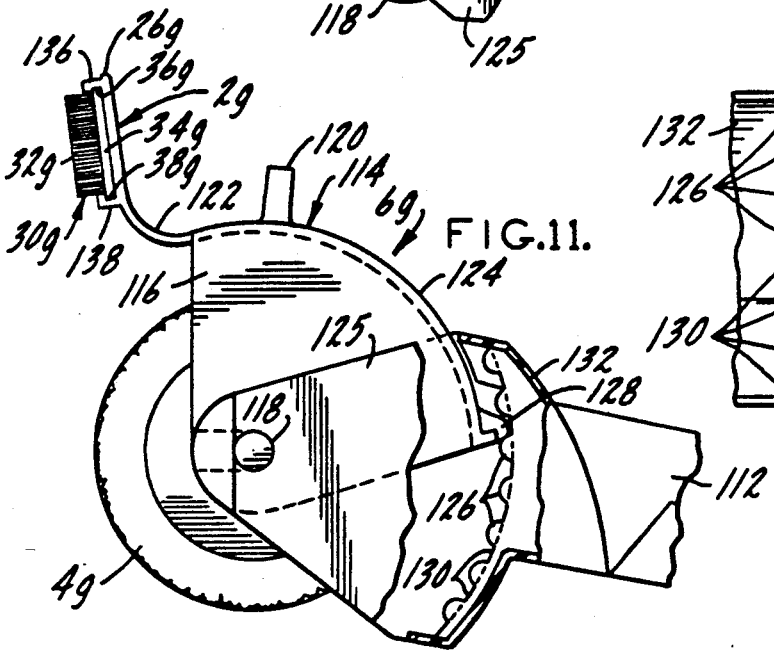
FIG. 11 is an end view, in partial section, of the assembly shown in FIG. 10.

FIG. 11 is an enlarged end view, in partial section, of the assembly shown in FIG. 10. The pad carrier 2g has slots 36g and 38g which engage and retain a painting pad 30g, comprised of fibers 32g and a backing 34g. The plane defined by the base 34g and the pad support surface are held at a predetermined angle relative to the moveable shield 114. However, the position of the moveable shield 114 is adjustable relative to the crossmember 132, and the handle 112.

Figure 12:
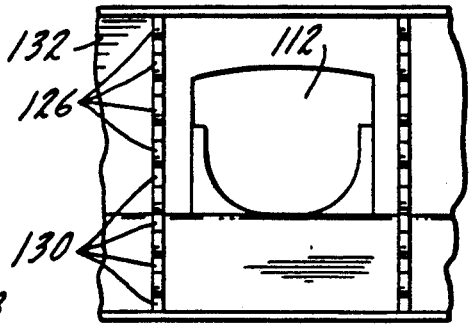
FIG. 12 is an elevational view of a component of the assembly shown in FIGS. 10 and 11.
Figure 13:
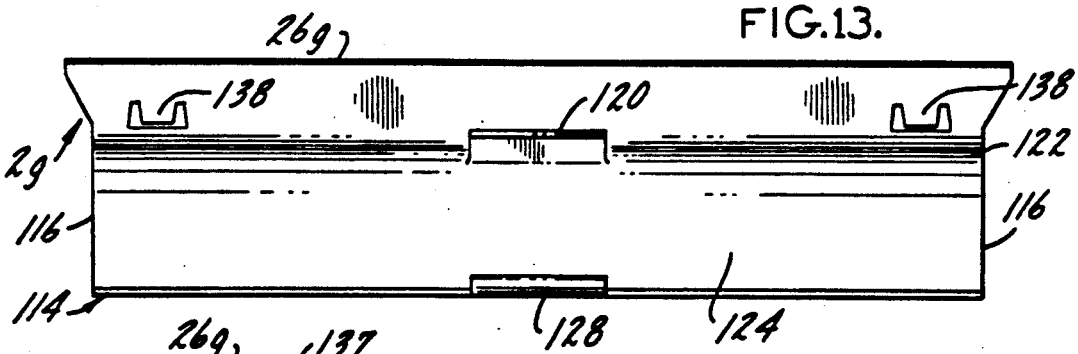
FIG. 13 is a top view of the adjustable shield and pad holder of the assembly shown in FIGS. 10 and 11.

The features of the present invention which allow for relative adjustment between the moveable, shield 114 and the crossmember 132 are most clearly shown in FIGS. 11, 12 and 13. A detent 128 carried by the moveable shield 114 engages the spaces 130 between the detents 126 carried by the crossmember 132. The detents 126 are disposed in two parallel arcuate arrays. The movable shield 114, and in particular the bridging section 124, should be made of a material which is strong yet flexible, such as injection molded plastic, so that the detent 128 can resiliently deflect radially relative to the post 118. Arcuate adjustment of the movable shield 114 relative to the crossmember 132 accomplishes two objectives. First, movement of the moveable shield causes a change in the extent to which the roller 4g is shielded. The amount of shielding provided by the moveable shield 114 will effect the amount of splatter which is distributed by the roller 4g, when the roller 4g is being used to apply paint. Secondly, when the pad 30g is being used to apply paint, movement of the shield 114 relative to the crossmember 132 will vary the angle between the plane of the pad 30g and the plane defined by the crossmember 132 and the handle 112. Adjustment of that angle may be of value when using the pad 30g to apply paint, particularly in the case of applying paint to intricate molding and similar complex shapes.

Another important aspect of the moveable shield/pad holder combination is that it may be removed from engagement with the crossmember 132 and side supports 125. The side supports 126 are flexible so that they may be spread an amount sufficient to allow removal of the roller 4g and the post 118. Similarly, the endwalls 116 of the moveable shield are resiliently flexible so that they may be spread to disengage the post 118. The roller and post 118 may then be reengaged with the side supports 126 to enable the assembly 110 to be used as a paint applicator without splatter shielding and without a pad attachment.

Figure 14:
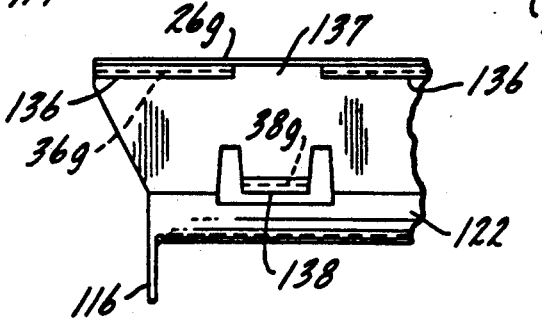
FIG. 14 is an enlarged elevational view of a portion of the pad holder shown in FIGS. 10, 11 and 13.
Figure 15:
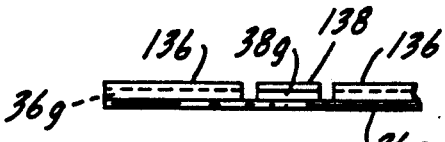
FIG. 15 is an enlarged view of the top of the portion of the pad holder shown in FIG. 14.

FIGS. 13, 14 and 15 show the features of the pad holder 2g which enable it to be made from a simple injection molding process. FIG. 13 is a view of the back or outside of the moveable shield 114, viewed as a separate element. The bumper or edge 26g runs along substantially the entire length of the pad holder 2g, and provides means for spacing the painting pad 30g and the bristles thereof away from an adjacent wall when painting corners. The slots 36g and 38g are formed in pad grippers 136 and 138, respectively. The pad gripper 136 extends substantially the full length of the upper portion of the pad holder 2g, except for two openings 137, which enable the formation of the partial pad grippers 138.

In this fifth embodiment, as with the first four embodiments, the pad carrier is removable from the means by which the paint roller is held. When a user has the need to apply paint by using an elongated narrow pad, the pad attachment can be quickly and easily installed. When painting with the pad is completed, the user can then remove the pad attachment from the assembly, and can continue painting larger areas with the roller alone. The ability to change from the "pad mode", when a pad is in a usable position on the roller assembly, to the "roller mode", when the pad attachment is removed from the roller assembly, is a significant aspect of the present invention. The fifth embodiment of the present invention provides for both removal of the paint pad holder and angular adjustment. Significantly, the angular adjustment of the pad holder can be accomplished simply by applying pressure to the pad holder sufficient to cause resilient movement of the detents which hold it in position. By fully retracting the moveable shield of the fifth embodiment, the user can go from the "pad mode" to a "modified roller mode" in which the paint roller housing is sized to allow substantial exposure of the paint roller.

In the fifth embodiment, changes between the pad mode and the modified roller mode can be accomplished without need for the user to touch the pad attachment itself. Rather, movement of the moveable shield, and the consequent movement of the pad attachment can be accomplished by the user with use of the knob provided, or simply by applying direct pressure to the pad attachment. Such pressure may be applied by simply holding the assembly with the handle 112 and pressing the entire assembly against any convenient surface to cause opening or closing of the moveable shield. Whether the user uses the knob provided on the moveable shield or direct pressure to the pad holder, there is no need for the user to touch any portion of the paint roller assembly which may contain paint. In addition, complete removal of the various pad attachments means from the paint roller supporting means can be accomplished quickly and easily because of the simplicity of the resilient clip-like and other attachment means which do not include any threaded or other complex fastening devices.

The foregoing detailed description has been given for clearness of understanding only, and no unnecessary limitations should be understood therefrom as some modifications will be obvious to those skilled in the art.

We claim:

1. In combination with a yoke-like paint roller assembly having a shield, a painting pad attachment device comprising a pad support providing means for applying even pressure to a painting pad lying adjacent thereto, said pad support including a support surface which is generally flat so as to receive and support a painting pad disposed adjacent thereto, resilient means integrally formed with said support for removably attaching said device to the paint roller assembly, said resilient means comprising a clip extending from a position adjacent to said support surface, said clip having opposing legs which snap onto an edge of the shield in nonrotatable engagement therewith, whereby the paint roller assembly is useable, in the alternative, to apply paint with a shielded roller and with a pad.

2. A painting pad attachment device in accordance with claim 1 wherein:

said device includes first and second slotted opposing retaining means for holding a painting pad in mechanical engagement with said support surface.

3. In a paint roller assembly, including a cylindrical roller, a roller support including a crossmember, a handle extending from said cross member, a painting pad attachment device carried by and removable from said roller assembly, said paint roller assembly being useable to apply paint when said pad attachment device is removed therefrom, said device comprising a pad support providing means for applying even pressure to a painting pad lying adjacent thereto, resilient means integrally formed with said pad attachment device for removably attaching said device to said paint roller assembly, said device comprising a removable extension of said crossmember which, when attached to said paint roller assembly, reduces splatter of paint droplets generated by said roller, and said resilient means comprising a pair of resilient arms extending from said pad attachment device and holding said pad support away from said roller support.

4. A painting pad attachment device in accordance with claim 3 wherein:

said device includes an arcuate removable shield generally partially cylindrical section and apertured side supports generally perpendicular thereto, said shield being moveable in an arcuate path to a plurality of positions.

5. A painting pad attachment device in accordance with claim 4 wherein:

said side supports have apertures which are sized to fit over and engage protrusion on ends of a paint roller, said supports being resiliently moveable to snappingly retain said roller in positive engagement with said shield.

6. A painting pad attachment device in accordance with claim 5 wherein:

said pad support extends from and is generally parallel to said partially cylindrical section.

* * * * *